US007147084B2

(12) United States Patent
Jahkonen

(10) Patent No.: US 7,147,084 B2
(45) Date of Patent: Dec. 12, 2006

(54) ELEVATOR CONTROL USING SWITCHED SPEED AND POSITION

(75) Inventor: Pekka Jahkonen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 24 days.

(21) Appl. No.: 11/202,018

(22) Filed: Aug. 12, 2005

(65) Prior Publication Data

US 2006/0027424 A1 Feb. 9, 2006

Related U.S. Application Data

(63) Continuation of application No. PCT/FI2004/000088, filed on Feb. 24, 2004.

(51) Int. Cl.
*B66B 1/24* (2006.01)

(52) U.S. Cl. ..... 187/293; 187/247

(58) Field of Classification Search ..... 187/247, 187/248, 291–293, 284, 295, 394; 318/59, 318/66, 68, 268, 278
See application file for complete search history.

(56) References Cited

U.S. PATENT DOCUMENTS 3,785,463 A 1/1974 Kuhl et al.
4,527,662 A * 7/1985 Doane et al. ..... 187/293
4,658,935 A * 4/1987 Holland ..... 187/293
4,751,984 A * 6/1988 Williams et al. ..... 187/293
5,612,517 A 3/1997 Johansson
5,785,153 A * 7/1998 Powell et al. ..... 187/249
6,050,368 A 4/2000 Pakarinen et al.
6,164,416 A 12/2000 Laine et al.
6,311,802 B1 * 11/2001 Choi et al. ..... 187/293

FOREIGN PATENT DOCUMENTS

FI 111930 B 1/1995
FI 950426 B 8/1996

OTHER PUBLICATIONS

Patent Abstracts of Japan, vol. 0144, No. 18, Sep. 10, 1990.

* cited by examiner

*Primary Examiner*—Jonathan Salata
(74) *Attorney, Agent, or Firm*—Birch, Stewart, Kolasch & Birch, LLP

(57) ABSTRACT

An elevator control method is provided, where the elevator motor is controlled in such manner that the velocity of the elevator follows a speed reference. When the elevator is decelerating, the motor is controlled by a speed adjustment method during the initial deceleration phase, and during the final deceleration phase the motor is controlled by a position adjustment method. The instant of transition from speed adjustment to position adjustment is determined substantially using the elevator speed curve.

12 Claims, 2 Drawing Sheets

ELEVATOR CONTROL USING SWITCHED SPEED AND POSITION

This application is a Continuation of co-pending PCT International Application No. PCT/FI2004/000088 filed on Feb. 24, 2004, which designated the United States, and on which priority is claimed under 35 U.S.C. § 120, the entire contents of which are hereby incorporated by reference. This Nonprovisional application also claims priority under 35 U.S.C. § 119(a) on Patent Application No(s). 20020303 filed in Finland on Feb. 27, 2003, the entire contents of which are hereby incorporated by reference.

BACKGROUND OF THE INVENTION

1. Field of the Invention

The present invention relates to an elevator control method and to an apparatus for controlling an elevator.

2. Description of the Related Art

In advanced alternating-current elevator drives, the motor is generally controlled by means of a frequency converter, which is used to adjust the torque and rotational speed of the motor. An individual elevator travel may be regarded as consisting of a departure, acceleration, a constant-speed portion, deceleration and stopping at a landing. The motor is normally controlled by using a speed reference such that the elevator will follow a predetermined speed curve as accurately as possible. An important task in elevator operation is to stop the elevator car exactly at the landing without sudden speed changes or without a need to move the car in the reverse direction.

Usually when an elevator is to be stopped, constant deceleration is used, and just before the stop the deceleration is changed at a preselected rate of change or jerk to achieve a final rounding of the speed curve. This method works well if the elevator follows the speed reference accurately.

In prior art, there are solutions designed to make the elevator follow the speed curve as accurately as possible down to the final deceleration. Such a solution is described e.g. in international patent application PCT/FI97/00265. However, the solution disclosed in this publication is complicated and it can therefore not be applied in all elevator drives.

However, when torque control is used in an elevator, following the speed reference is difficult because the torque control determines the overall torque of the system. Increasing the gain increases the torque, but this leads to problems of stability.

SUMMARY OF THE INVENTION

An aspect of the invention is to develop a new method for controlling an alternating-current motor for use in an elevator, a method that is simple to implement and enables an elevator car to be reliably stopped exactly at a floor level.

By the solution of the invention, at the final stage before the car stops at the landing, the motor is controlled by using a position reference. This results in a simple and reliable adjustment that is directly dependent on the distance to the desired stopping position. During the rest of the travel curve, a speed reference is observed, thus utilizing the advantages of speed adjustment.

According to a preferred embodiment, when the elevator is decelerating, the motor is controlled by a speed adjustment method at the final stage of deceleration, and at the final stage of deceleration the motor is controlled by a position adjustment method, and the instant of transition from speed adjustment to position adjustment is determined substantially by means of the elevator speed curve. The method of the invention has no effect on the normal travel time of the elevator, nor does it make the control during actual travel more complicated.

According to a second preferred embodiment, the instantaneous value of the speed curve is observed continuously and the motor control method is determined utilizing the instantaneous value of the speed curve.

According to yet another embodiment of the method, the remaining distance to the stopping position is continuously monitored and the motor control method is determined utilizing this remaining distance.

According to a further embodiment, when the elevator is decelerating, the motor is controlled by a speed adjustment method until a point is reached where the ratio between the acceleration and the speed is the same as the ratio between the remaining distance and the speed, and at this point the control is changed over to position adjustment. In this way, a control method is achieved that is independent of other drive parameters.

An apparatus for controlling an elevator according to yet another embodiment of the invention, said apparatus comprising means allowing the elevator motor to be controlled on the basis of position data and means whereby a selection can be made as to whether the elevator is to be controlled by means of a speed reference or by means of a position reference.

BRIEF DESCRIPTION OF THE DRAWINGS

In the following, the invention will be described in detail with reference to an embodiment and the attached drawings, wherein.

DETAILED DESCRIPTION

Figure 1:
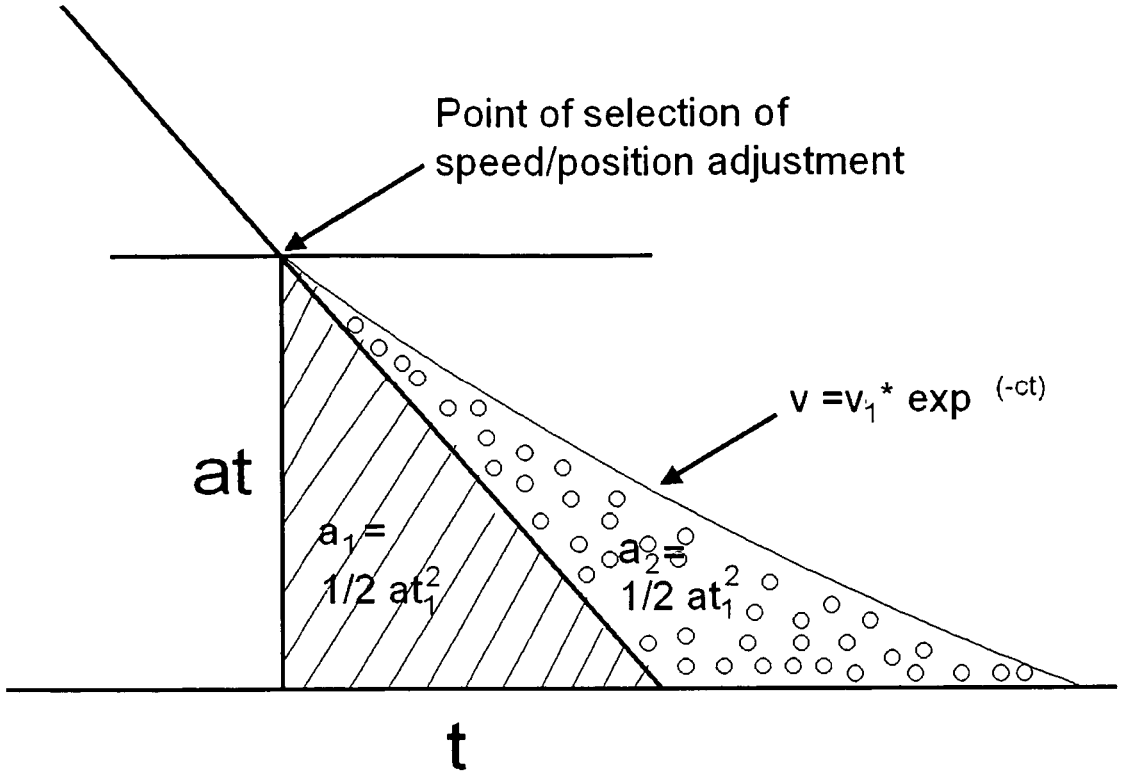
FIG. 1 illustrates the final deceleration of the speed curve.

According to FIG. 1, in normal operation the elevator travel curve comprises an initial acceleration, a constant acceleration stage, a constant velocity portion, a constant deceleration stage and a final deceleration. At the deceleration stage, the elevator's velocity is reduced with a constant deceleration, which is represented by portion $v_a$ of the speed curve in FIG. 1. At the constant deceleration stage, as is well known, equation $v_1=a*t_1$, where a is deceleration and t is time, applies for velocity, and equation $s_1=\frac{1}{2}*a*t_1^2$ applies for distance. In other words, when the elevator comes with constant deceleration to a halt, it travels through a distance of $s_1=\frac{1}{2}*a*t_1^2$ in time $t_1$. If a final rounding is added to the speed curve at the end of the deceleration stage, in which case the change in deceleration, i.e. the jerk is constant, and a jerk value is chosen such that the stopping distance is doubled, i.e. $s_2=2*s_1=a*t_1^2$, then the velocity can be resolved. For example, if the velocity falls exponentially and final rounding is started at instant $t=1/c=s_1/v_1=v_1/a$, then the values of velocity, deceleration and distance from the landing become simultaneously zero with a great accuracy.

In this situation, the following equations apply:

$$v=v_1*e^{-c*t},$$

$$d=1/c*v,$$

$$a=-c*v.$$

Thus, FIG. 1 illustrates the definition of the instant of time when the transition from speed adjustment to position adjustment occurs. The suggested instant is the instant when the remaining distance ($a_1+a_2$) equals twice the distance a, that the elevator would have to travel if no final rounding were made.

Figure 2:
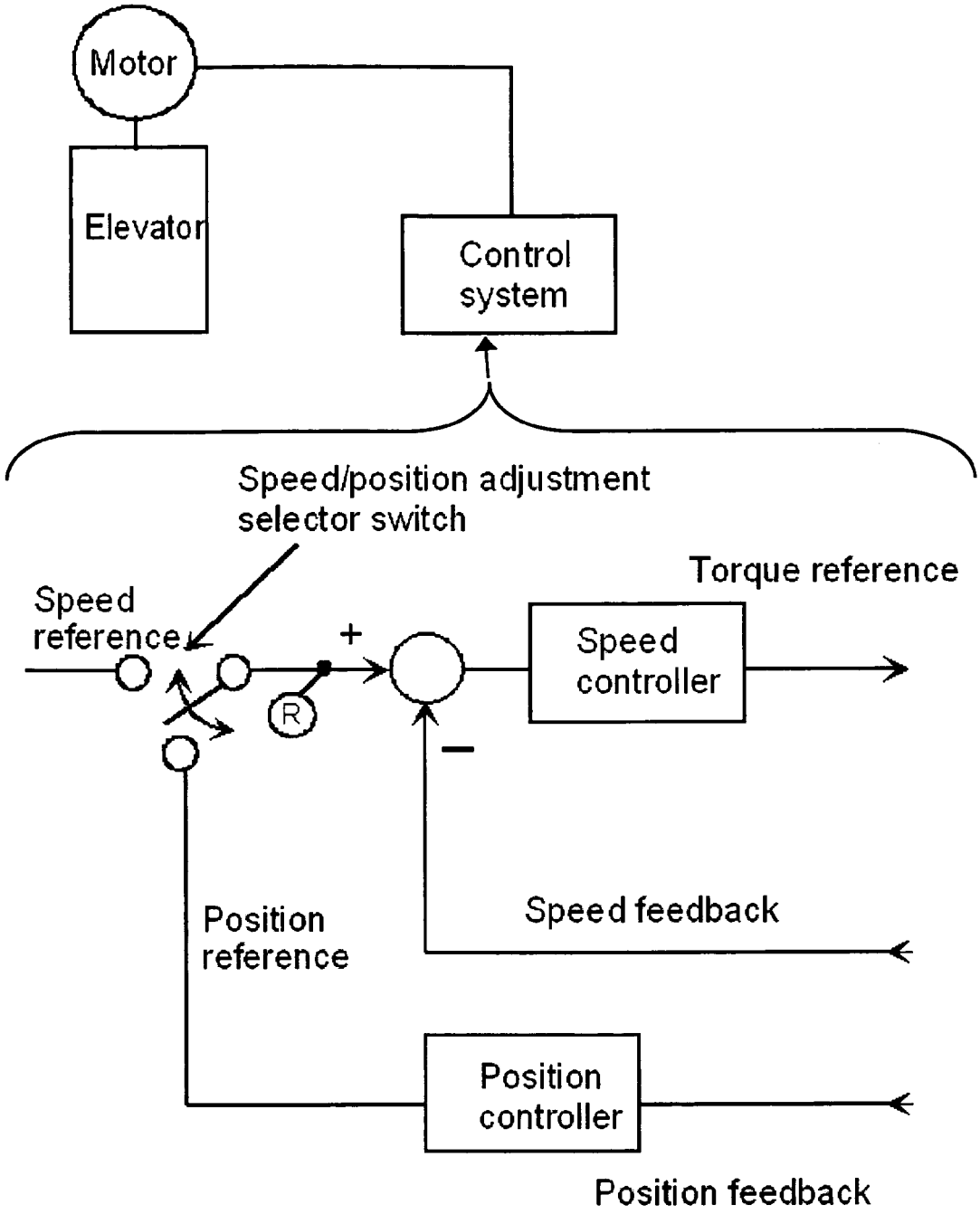
FIG. 2 is a diagrammatic representation of a control system implementing the method of the invention.

FIG. 2 represents a motor control system that implements the function of the invention. The ratio between the velocity and acceleration of the elevator is compared to the ratio between the remaining distance and the velocity. When these two ratios are equal, control is changed over from the constant deceleration stage to the final deceleration and the velocity is controlled in accordance with the exponential. function $v=v_1*e^{-c*t}$. According to FIG. 2, the transition to position adjustment is accomplished by connecting the actual value signal R of the speed controller to the position reference instead of to the speed reference, the position reference being a certain function of the distance to the landing measured by a position feedback arrangement.

The above description is not to be regarded as a limitation of the sphere of patent protection; instead, the embodiments of the invention may be freely varied within the limits defined in the claims.

The invention claimed is:

1. An elevator control method, wherein the elevator motor is controlled in such a manner that the velocity of the elevator follows a speed reference, and that, when the elevator is decelerating, the motor is controlled by a speed adjustment method during the initial deceleration phase and that the motor is controlled by a position adjustment method during the final deceleration phase, wherein the instant of transition from speed adjustment to position adjustment is based upon parameters associated with the elevator speed curve.

2. The method according to claim 1, wherein the instantaneous value of the speed curve is monitored continuously and the motor control method is determined utilizing the instantaneous value of the speed curve.

3. The method according to claim 1 or 2, wherein the remaining distance to the stopping position is continuously monitored and the motor control method is determined utilizing the this remaining distance.

4. The method according to claim 1, wherein when the elevator is decelerating, the motor is controlled by the speed adjustment method until a point is reached where the ratio between the acceleration and the speed is the same as the ratio between the remaining distance and the speed, and that at this point the control is changed over to a position adjustment.

5. An apparatus for controlling an elevator, said apparatus comprising means allowing the elevator motor to be controlled on the basis of a position reference or a speed reference, wherein the apparatus comprises means for determining the instant of the transition whereby the elevator motor control is selected from the speed reference to the position reference.

6. An apparatus for controlling an elevator, comprising:

a speed controller which adjusts a rotational speed of a motor powering the elevator;

a position controller which provides a position reference; and a selector switch, operatively coupled to the speed controller and the position controller, which provides the speed controller either a speed reference or the position reference, depending upon parameters associated with an elevator speed curve.

7. The apparatus according to claim 6, wherein the position reference is based upon a distance to a landing measured by a position feedback arrangement.

8. The apparatus according to claim 6, wherein the transitioning between the speed reference and the position reference is determined at a time based upon the parameters associated with the elevator speed curve and a distance to a landing.

9. The apparatus according to claim 8, wherein during deceleration, the speed controller utilizes the speed reference for control, and switches to using the position reference for control when a ratio between an acceleration and a speed is substantially the same as a ratio between a remaining distance and the speed.

10. The apparatus according to claim 6, wherein the transitioning between the speed reference and the position reference is determined at a time based upon the parameters associated with the elevator speed curve and a distance to a landing.

11. The apparatus according to claim 6, wherein an instantaneous value of the elevator speed curve is monitored continuously and the speed controller utilizes the instantaneous value of the speed curve.

12. The apparatus according to claim 6, wherein a remaining distance to the stopping position is continuously monitored and the speed controller utilizes the remaining distance.

* * * * *

UNITED STATES PATENT AND TRADEMARK OFFICE

CERTIFICATE OF CORRECTION

PATENT NO. : 7,147,084 B2
APPLICATION NO. : 11/202018
DATED : December 12, 2006
INVENTOR(S) : Pekka Jahkonen It is certified that error appears in the above-identified patent and that said Letters Patent is hereby corrected as shown below:

Title Page and Col. 1 Line 1
In the Application:

the title "Elevator Control Using Switched Speed and Position"

Should read:

--Elevator Control Using Switched Speed and Position References--

Insert (30) Foreign Application Priority Data

--Feb. 27, 2003 (FI)…….20030303--

Signed and Sealed this

Fifteenth Day of January, 2008

JON W. DUDAS
*Director of the United States Patent and Trademark Office*